US009095860B2

(12) United States Patent
Zhou et al.

(10) Patent No.: US 9,095,860 B2
(45) Date of Patent: Aug. 4, 2015

(54) SHOWER WITH WATERWAY SWITCH CONTROLLED BY ELECTRONIC TOUCH

(75) Inventors: Huasong Zhou, Xiamen (CN); Xianguo Zou, Xiamen (CN); Jianmin Chen, Xiamen (CN)

(73) Assignees: XIAMEN SOLEX HIGH-TECH INDUSTRIES CO., LTD., Xiamen (CN); Huasong Zhou, Xiamen (CN)

( * ) Notice: Subject to any disclaimer, the term of this patent is extended or adjusted under 35 U.S.C. 154(b) by 463 days.

(21) Appl. No.: 13/496,442

(22) PCT Filed: Dec. 31, 2010

(86) PCT No.: PCT/CN2010/080576

§ 371 (c)(1), (2), (4) Date: Mar. 15, 2012

(87) PCT Pub. No.: WO2011/079816

PCT Pub. Date: Jul. 7, 2011

(65) Prior Publication Data

US 2012/0181462 A1 Jul. 19, 2012

(30) Foreign Application Priority Data

Dec. 31, 2009 (CN) ..... 2009 1 0266869
Dec. 31, 2009 (CN) ..... 2009 2 0214998 U

(51) Int. Cl.

| | |
|---|---|
| ***A62C 31/00*** | (2006.01) |
| ***B05B 9/08*** | (2006.01) |
| ***B05B 1/18*** | (2006.01) |
| ***B05B 1/16*** | (2006.01) |
| ***B05B 12/00*** | (2006.01) |

(52) U.S. Cl.

CPC ..... *B05B 1/18* (2013.01); *B05B 1/1609* (2013.01); *B05B 12/002* (2013.01)

(58) Field of Classification Search

USPC ..... 239/67, 69, 443, 444, 525, 530, 548, 239/569, DIG. 11; 251/65, 129.04; 137/801, 137/862, 883

See application file for complete search history.

(56) References Cited

U.S. PATENT DOCUMENTS

| | | | | |
|---|---|---|---|---|
| 7,997,301 | B2 * | 8/2011 | Marty et al. | 239/443 |
| 8,061,631 | B2 * | 11/2011 | Lev | 239/391 |
| 8,118,240 | B2 * | 2/2012 | Rodenbeck et al. | 239/67 |
| 2009/0227931 | A1 | 9/2009 | Petrie | |

FOREIGN PATENT DOCUMENTS

| | | | |
|---|---|---|---|
| CN | 201316206 | Y | 9/2009 |
| CN | 101733208 | A | 6/2010 |
| CN | 201572692 | U | 9/2010 |

* cited by examiner

*Primary Examiner* — Steven J Ganey
(74) *Attorney, Agent, or Firm* — Rabin & Berdo, P.C.

(57) ABSTRACT

A shower with electronic touch control of waterway switch, has a fixing seat, a power generation mechanism, an effluent unit and a control unit. The fixing seat has a main waterway connecting to the water source and at least two branch waterways, and each the branch waterway is connected to the main waterway through a magnetic valve. The power generation mechanism is fixed in the fixing seat. The effluent unit is fixed to the fixing seat and has effluent functions corresponding to each of the branch waterways. The control unit comprises a circuit board fixed in the fixing seat and a touch panel fixed outside the fixing seat, and the circuit is connected to the power generation mechanism, and the circuit board is connected to the touch panel, and the circuit board is connected to the three magnetic valves with signals to control the magnetic valves with the control signals.

10 Claims, 8 Drawing Sheets

SHOWER WITH WATERWAY SWITCH CONTROLLED BY ELECTRONIC TOUCH

FIELD OF THE INVENTION

The present invention relates to a shower with waterway switch controlled by electronic touch.

BACKGROUND OF THE INVENTION

The control unit of the shower at the prior art are all mechanical switch, such as the rotation switch, the sliding switch, the swinging switch and so on. The defects of the mechanical switch are: 1 the users need to exert certain applied force to achieve the switching operation, and it is not convenient to switch; 2 it cannot fulfill the need of some old folks and disabled persons.

SUMMARY OF THE INVENTION

The object of the present invention is to offer a shower with waterway switch controlled by electronic touch, which overcome the defects of mechanical switch at the prior art.

One of the technical proposals to solve the technical matters in the present invention is:

A shower with waterway switch controlled by electronic touch, it comprises:

A fixing seat, it has a main waterway connecting to the water source and at least two branch waterways, and each the said branch waterway is connected to the main waterway through a magnetic valve;

A power generation mechanism, it is fixed in the fixing seat and generates electric energy by the impact of the water flow in the main waterway;

An effluent unit, it is fixed to the fixing seat and has the effluent functions corresponding to each of the branch waterways;

And a control unit, it comprises a circuit board fixed in the fixing seat and a touch panel fixed outside the fixing seat, and the said circuit is connected to the power generation mechanism to gain the electric energy, and the said circuit board is signaling connected to the touch panel to receive the touch signals from the users and figure out the control signals according to the touch signals, and the said circuit board is connected to the magnetic valves to control the on and off of the magnetic valves with the control signals, and the said touch panel is located at the end of the shower's effluent face or the shower's lateral face.

In a preferred embodiment, the said fixing seat comprises a top cover, a bottom cover, a supporting seat and a sealing cover, and the said bottom cover and the top cover are fixed together, and the said supporting seat is set between the bottom cover and the top cover; the bottom surface of the said supporting seat sinks and forms a concave cavity, and the said sealing cover seals the opening of the concave cavity, and a connecting channel is opened in the top surface of the supporting base, and the upper end of the connecting channel is hermetically connected to the main waterway, and the lower end of the connecting channel is connected to the concave cavity; the lateral face of the supporting seat sinks and forms the said branch waterways; the top surface of the supporting seat sinks and forms several mounting holes, and each mounting hole is connected to a branch waterway and the concave cavity;

The said magnetic valves are mounted in the said mounting holes and can control the connection between the concave cavities and the branch waterways on and off.

In a preferred embodiment, the said circuit board is set between the supporting seat and the bottom cover.

In a preferred embodiment, the said power generation mechanism is set between the supporting seat and the top cover, and is connected to the main waterway.

In a preferred embodiment, the said effluent unit is fixed on the lateral face of the fixing seat, and the effluent face of the said effluent unit forms an included angle with the bottom surface of the bottom cover, and the said touch panel is set on the bottom surface of the bottom cover.

In a preferred embodiment, the said fixing seat further comprises a connecting seat, and the connecting seat is hermetically fixed on the supporting seat, and a containing cavity is formed between the connecting seat and the supporting seat, and a oblique water hole connecting the main waterway is opened in the said connecting seat, and the containing cavity connects the oblique water hole and the connecting channel;

The said power generation mechanism has a generator and a impeller, the said generator is fixed between the connecting seat and the top cover, and the rotation shaft of the said generator penetrates the connecting seat from top to bottom and enters the containing cavity, and the said impeller is set in the containing cavity, connected to the rotation shaft.

In a preferred embodiment, a fixing sleeve used for fixing and sleeving the generator is fixed on the said connecting seat, and the said main waterway is set on the fixing sleeve, connecting the water source and the oblique water hole.

In a preferred embodiment, the said fixing seat comprises a top cover and a supporting seat, the said effluent unit is under the fixing seat and fixed with the top cover, and the said supporting seat is set between the effluent unit and the top cover;

The bottom surface of said supporting seat sinks and forms a concave cavity, the said effluent unit is hermetically fixed to the opening of the concave cavity, and a connecting channel is opened in the top surface of the said supporting seat, and the upper end of the said connecting channel is hermetically connected to the main waterway, and the lower end of the said connecting channel is connected to the concave cavity; the bottom surface of the supporting seat sinks and forms the said branch waterways; the top surface of the said supporting seat sinks and forms several mounting hole, and each mounting hole connects a branch water way and the concave cavity;

The said magnetic valve is mounted in the mounting hole and controls the connection between the concave cavity and the branch waterways on and off.

In a preferred embodiment, it further comprises a storage battery of which the input end is connected to the output end of the generator, and the generator directly charges the storage battery when the magnetic valve is not working.

Another technical proposal to solve the technical matters in the present invention is:

A shower with waterway switch controlled by electronic touch, it comprises:

A fixing seat, it has a main waterway connecting to the water source and at least two branch waterways, and each the said branch waterway is connected to the main waterway through a magnetic valve;

A battery, it is fixed in the fixing seat and generates electric energy;

An effluent unit, it is fixed to the fixing seat and has the effluent functions corresponding to each of the branch waterways;

And a control unit, it comprises a circuit board fixed in the fixing seat and a touch panel fixed outside the fixing seat, and the said circuit is connected to the battery to gain the electric energy, and the said circuit board is signaling connected to the touch panel to receive the touch signals from the users and figure out the control signals according to the touch signals, and the said circuit board is connected to the magnetic valves to control the on and off of the magnetic valves with the control signals.

In a preferred embodiment, the said fixing seat comprises a top cover, a bottom cover, a supporting seat and a sealing cover, and the said bottom cover and the top cover are fixed together, and the said supporting seat is set between the bottom cover and the top cover; the bottom surface of the said supporting seat sinks and forms a concave cavity, and the said sealing cover seals the opening of the concave cavity, and a connecting channel is opened in the top surface of the supporting base, and the upper end of the connecting channel is hermetically connected to the main waterway, and the lower end of the connecting channel is connected to the concave cavity; the lateral face of the supporting seat sinks and forms the said branch waterways; the top surface of the supporting seat sinks and forms several mounting holes, and each mounting hole is connected to a branch waterway and the concave cavity;

The said magnetic valves are mounted in the said mounting holes and can control the connection between the concave cavities and the branch waterways on and off.

Compared with the shower at the prior art, the benefits of the shower in the present invention are:

1 it combines the electric touch control, power generation mechanism and the waterway switch together in the shower field and make them cooperate with the shower, so that the switch is convenient, labour-saving and rapid without external power and embedding in the wall;

2 It cooperates effectively with the magnetic valve and the waterway switch through the connecting channel, concave cavity and the mounting holes of the supporting seat; the layout is reasonable, the structure is compact, and it can reduce the space occupation effectively and cooperates with the shower directly;

3 The power generation mechanism cooperates with the water flow in the main waterway, so that the charging can be achieved by just opening the main effluent switch of the shower without additional battery;

4 The circuit board is set between the supporting seat and the bottom cover (effluent unit), so that the sealing is guaranteed, segregating the circuit board from the water;

5 The effluent face of the effluent unit forms an included angle with the bottom surface of the bottom cover, the touch panel is under the bottom surface of the bottom cover, the layout is reasonable, the control fit the human kinesiology and the user experience is good.

6 The connecting seat cooperates with the power generation mechanism through the containing cavity of the connecting seat and the oblique water hole, so that the power of hydroelectric power is enhanced;

7 The fixing sleeve is set, it not only locates the connecting seat and the supporting seat, and fixes the generator, but also forms the main waterway and lays the water flow direction in the waterway.

BRIEF DESCRIPTION OF THE DRAWINGS

With the following description of the drawings and specific embodiments, the invention shall be further described in details.

DESCRIPTION OF THE PREFERRED EMBODIMENTS

Embodiment 1

Figure 1:
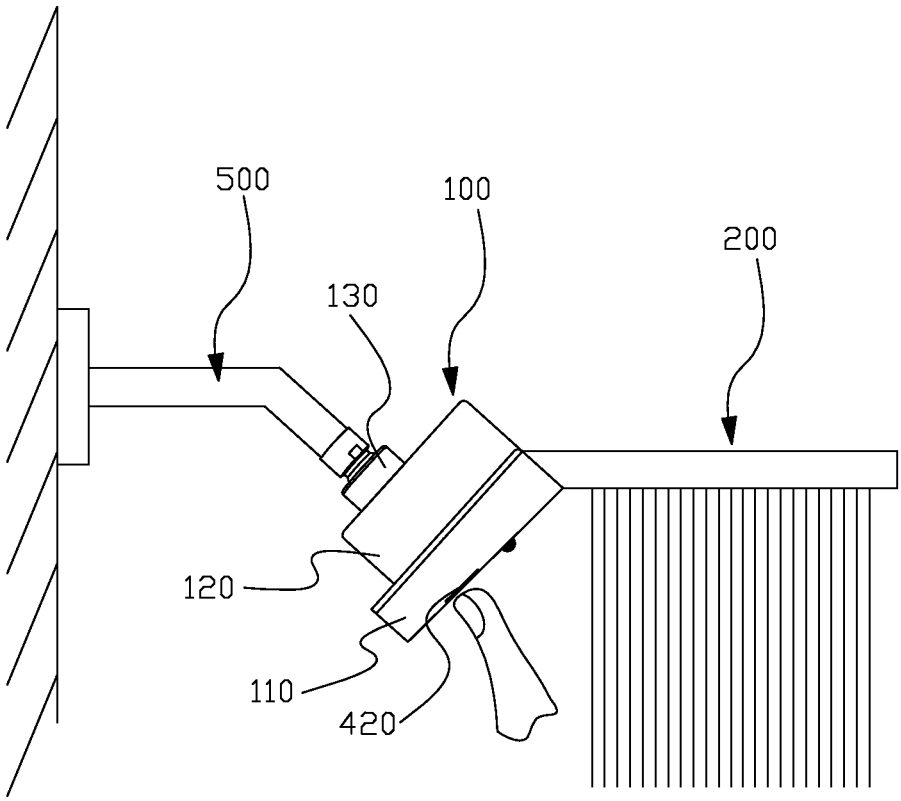
FIG. 1 shows the active condition view of the shower in the present invention according to the preferred embodiment 1.
Figure 2:
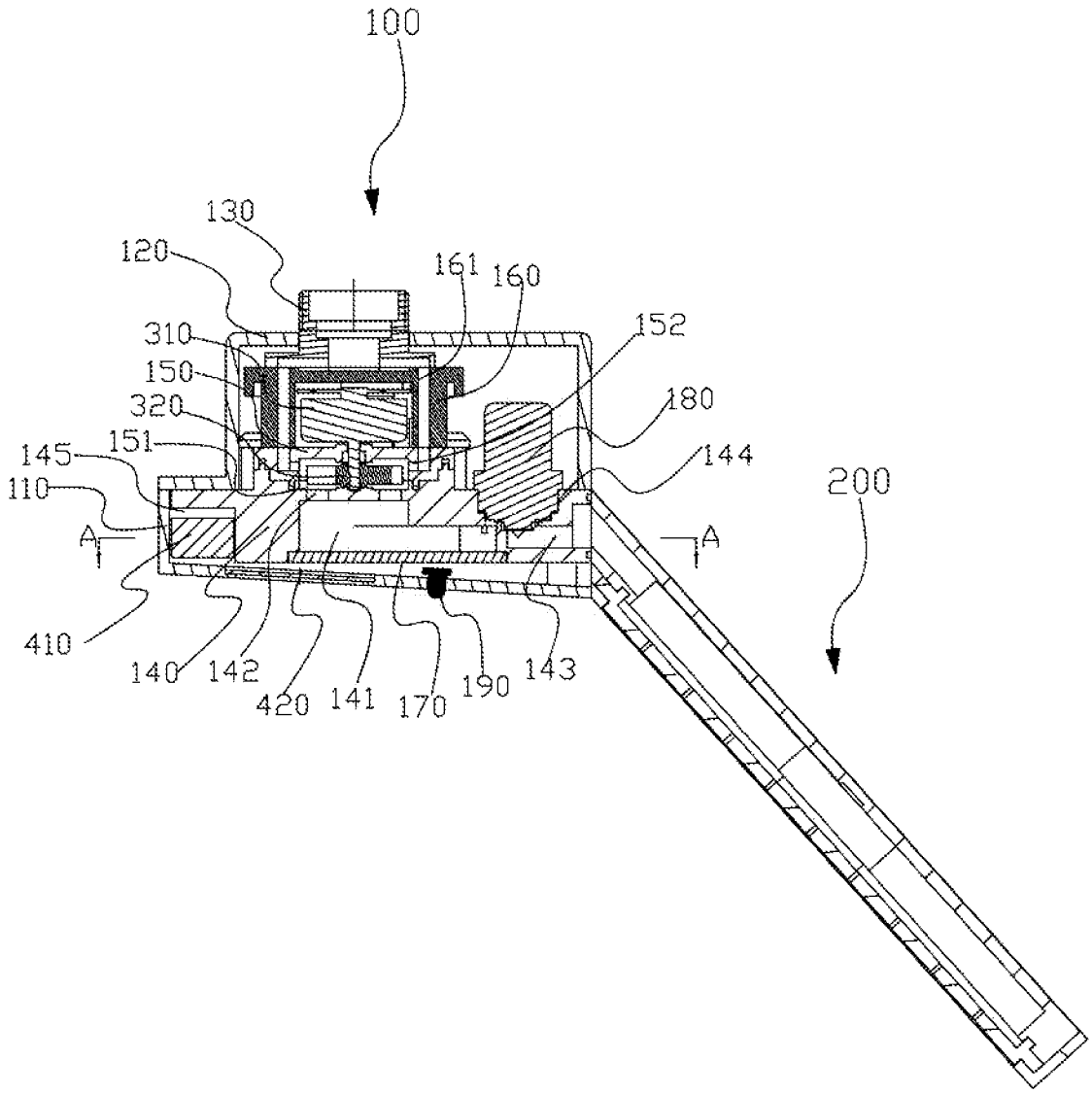
FIG. 2 shows the diagrammatic cross-section of the shower in the present invention according to the preferred embodiment 1.
Figure 3:
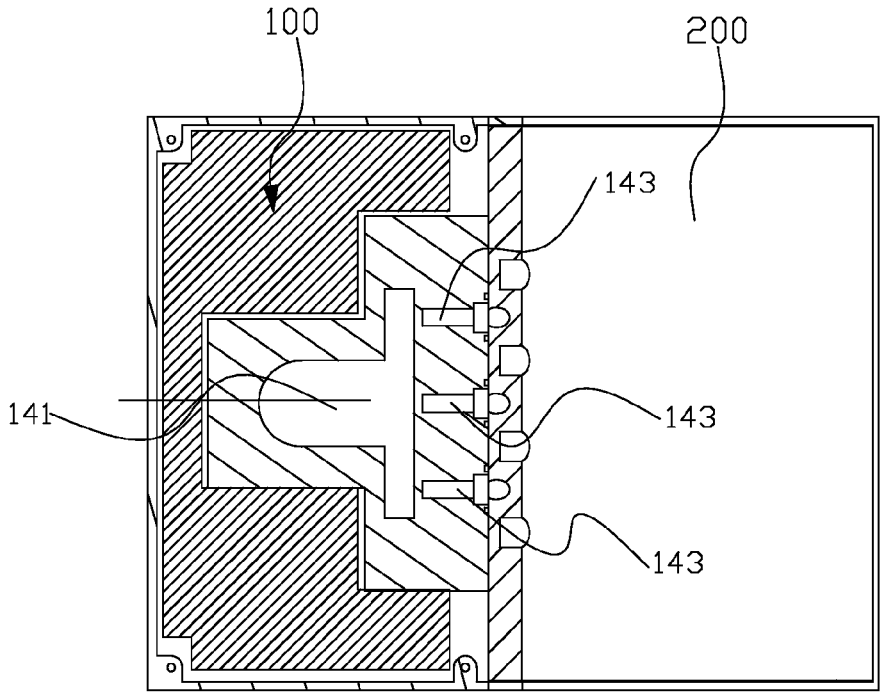
FIG. 3 shows the diagrammatic cross-section of FIG. 2A-A.
Figure 4:
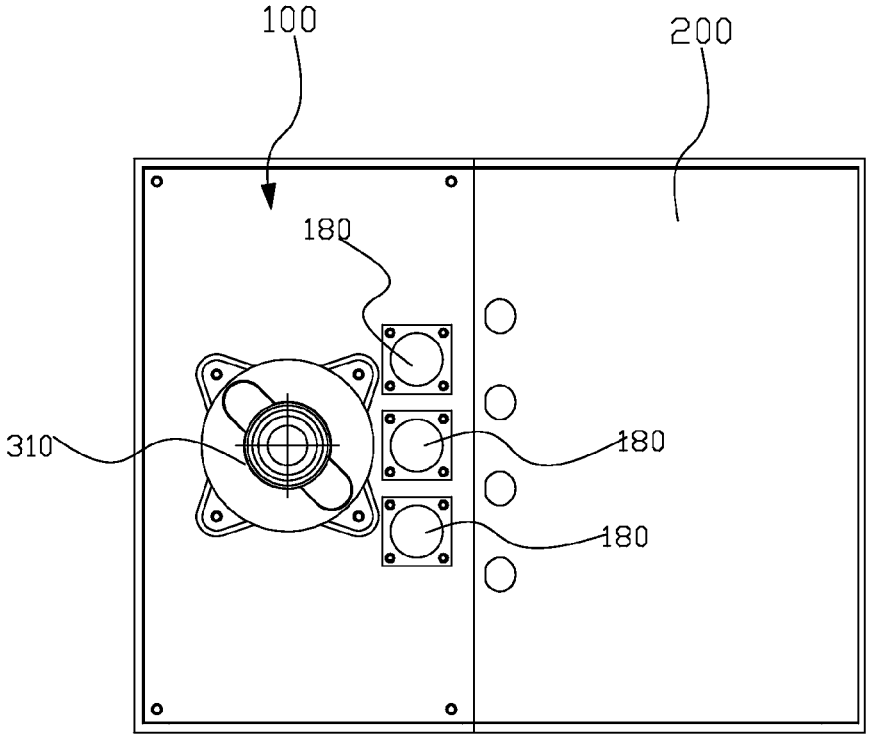
FIG. 4 shows the vertical view of the shower without the top cover in the present invention according to the preferred embodiment 1.

As shown in FIG. 1, FIG. 2, FIG. 3 and FIG. 4, it is the abridged general view of the shower with waterway switch controlled by electronic touch in the present invention.

A shower with waterway switch controlled by electronic touch, it comprises a fixing seat 100, a power generation mechanism, an effluent unit 200 and a control unit. The effluent unit with three effluent ways is taken as an example in the present embodiment, but it is not limited, others are fit to the present invention such as two or four.

The said fixing seat 100 comprises a bottom cover 110, a top cover 120, an interface 130, a supporting seat 140, a connecting seat 150, a fixing sleeve 160, a sealing cover 170 and three magnetic valves 180 (it is equal to the count of the effluent way).

The said bottom cover 110 and the top covers 120 are fixed to each other and form a shell together.

A perforative through hole is opened in the said top cover 120, and the said interface 130 is fixed on the through hole of the top cover 120 to connect the water resource and to achieve fixing connection, such as connecting to the American supporting arm 500 in FIG. 1.

The said supporting seat 140 is fixed on the bottom cover 110, and the said connecting seat 150 is fixed on the supporting seat 140, and the said fixing sleeve 160 is fixed to the interface 130 and between the top cover 120 and the connecting seat 150, namely the supporting seat 140, the connecting seat 150 and the fixing sleeve 160 are fixed in the shell formed by the bottom cover 110 and the top cover 120.

The bottom surface of the supporting seat 140 sinks and forms a concave cavity 141, and the said sealing cover 170 seals the opening of the concave cavity 141, and a connecting channel 142 is opened in the top surface of the said supporting seat 140, and the upper end of the said connecting channel 142 is connected to the main waterway 161, and the lower end of the said connecting channel 142 is connected to the concave cavity 141; the lateral face of the said supporting seat 140 sinks and forms three independent branch waterways 143; the top surface of the said supporting seat 140 sinks and forms three mounting holes 144, each mounting hole 144 is connected to a branch waterway 143 and the concave cavity 141. The said magnetic valves 180 are mounted in the mounting holes 144 and control the connection of the branch waterways 143 and the concave cavity 141. A notch 145 is set at the lower part of the edge part of the said supporting seat 140.

The said connecting seat 150 is hermetically fixed on the supporting seat 140, and a containing cavity 151 is formed between the said connecting seat 150 and the supporting seat 140, and a oblique water hole 150 connecting the main waterway 161 is opened in the said connecting seat 150, and the said containing cavity 151 connects the oblique water hole 152 with the connecting channel 142.

The said fixing sleeve 160 is fixed to the interface 130 and between the top cover 120 and the connecting seat 150, in which a main waterway 161 connecting the interface 130 and the oblique water hole 152 is opened.

The said power generation mechanism has a generator 310 and a impeller 320, the generator 310 is fixed in the fixing sleeve 160, the rotation shaft of the said generator 310 penetrates the connecting seat 150 from top to bottom and enters the containing cavity 151, and the said impeller 320 is set in the containing cavity 151 and is connected to the rotation shaft. The power generation mechanism generates electric energy by the impact of the water flow in the main waterway.

The said control unit comprises a circuit board 140 and a touch panel 420. The said circuit board 410 is set at the notch 145 of the supporting seat 140 and fixed with the bottom cover 110 through the supporting seat 140. The said touch panel 420 is set on the bottom surface of the bottom cover 110. The said circuit board 410 is connected to the generator 310 of the power generation mechanism to gain the electric energy, and the said circuit board 410 is connected to the touch panel 420 to receive the touch signals of the users and figure out the control signals according to the touch signals of the users, and the said circuit board 410 is connected to the three magnetic valves 180 with signals to control the on and off of the magnetic valves 180 with the control signals.

According to the need of the users, an indicator light 190 can be set on the bottom surface of the bottom cover, and it is signaling connected to the circuit board 410, indicating the work of one of the three magnetic valves by different colors.

The effluent unit 200 is fixed on the lateral face of the fixing seat 100, and the effluent face of the effluent unit form an included angle with the bottom surface of the bottom cover. The said effluent unit 200 has three effluent functions; each of the said three effluent functions is connected to each of the branch waterways respectively.

The waterway of the shower in the present embodiment is the interface 130, the main waterway 161, the oblique water hole 152, the containing cavity 151, the connecting channel 142, the concave cavity 141, the magnetic valve 180, the branch waterway 143 and the effluent function.

Embodiment 2

Figure 5:
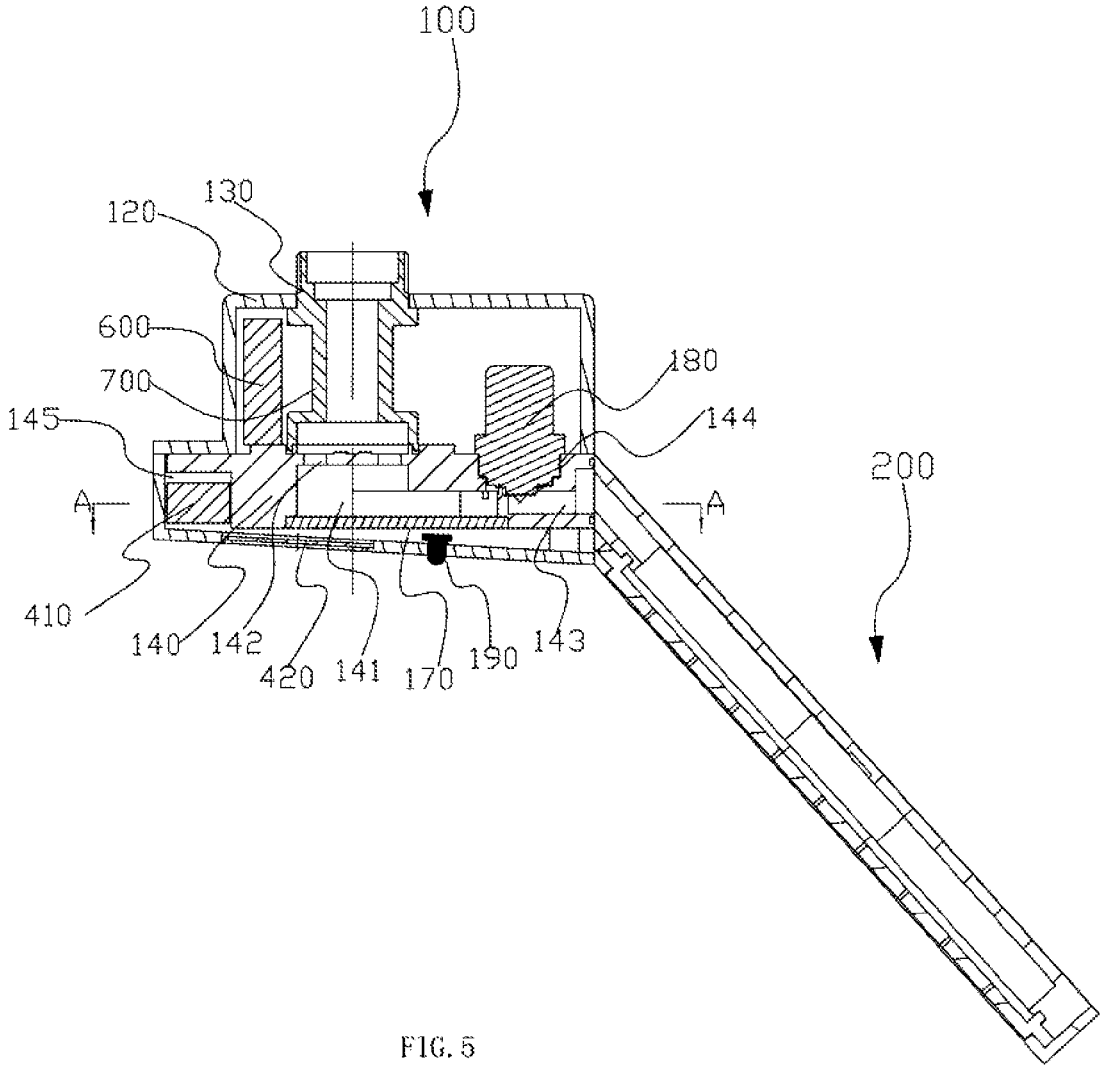
FIG. 5 shows the diagrammatic cross-section of the shower in the present invention according to the preferred embodiment 2.

As shown in FIG. 5, the differences from the previous embodiment are: the power generation mechanism is replaced by the battery 600; the fixing seat and the connecting seat are not needed, a water catching pipe 700 is fixed between the interface and the supporting seat, connecting the interface and the waterway.

Embodiment 3

Figure 6:
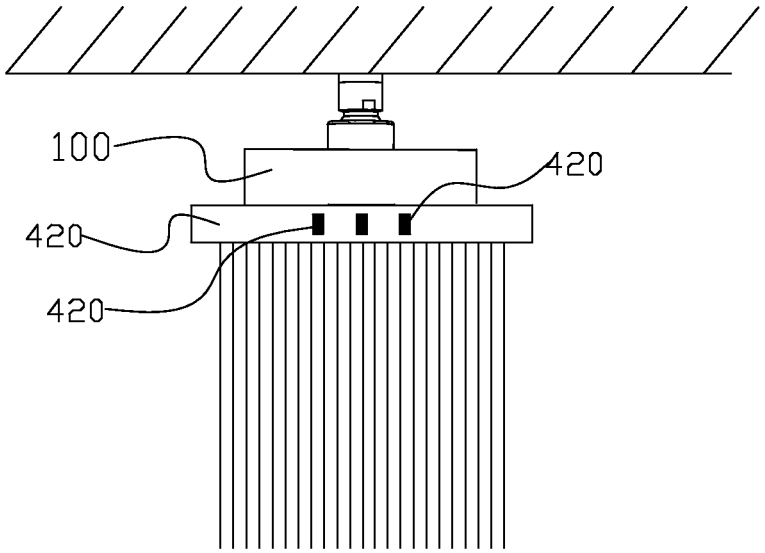
FIG. 6 shows the active condition view of the shower in the present invention according to the preferred embodiment 3.
Figure 7:
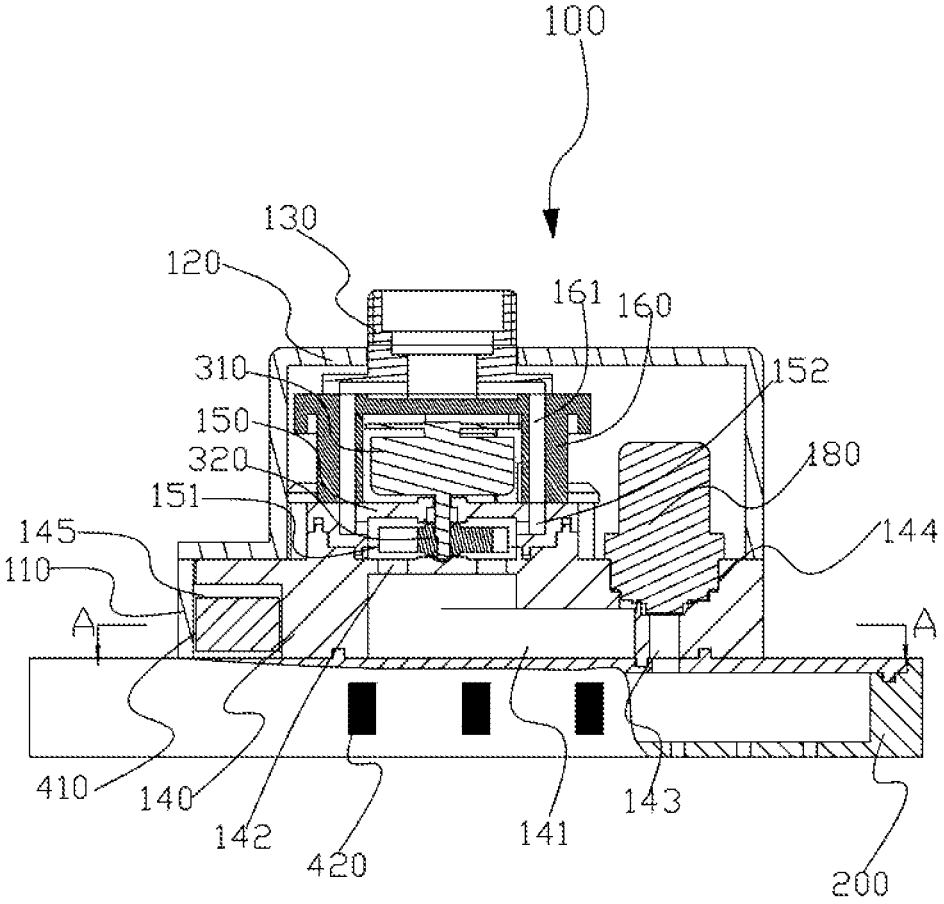
FIG. 7 shows the diagrammatic cross-section of the shower in the present invention according to the preferred embodiment 3.
Figure 8:
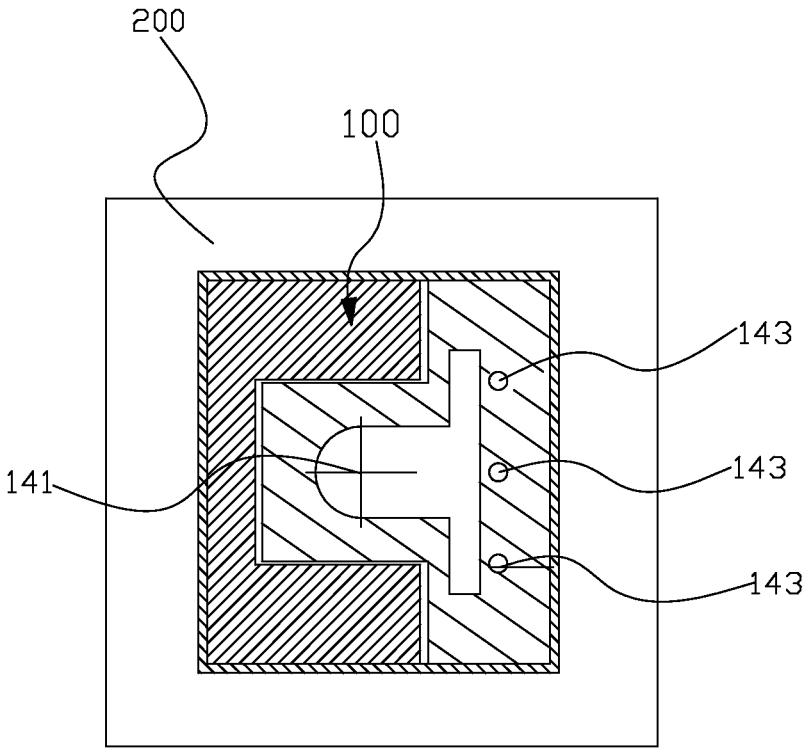
FIG. 8 shows the diagrammatic cross-section of FIG. 7B-B.
Figure 9:
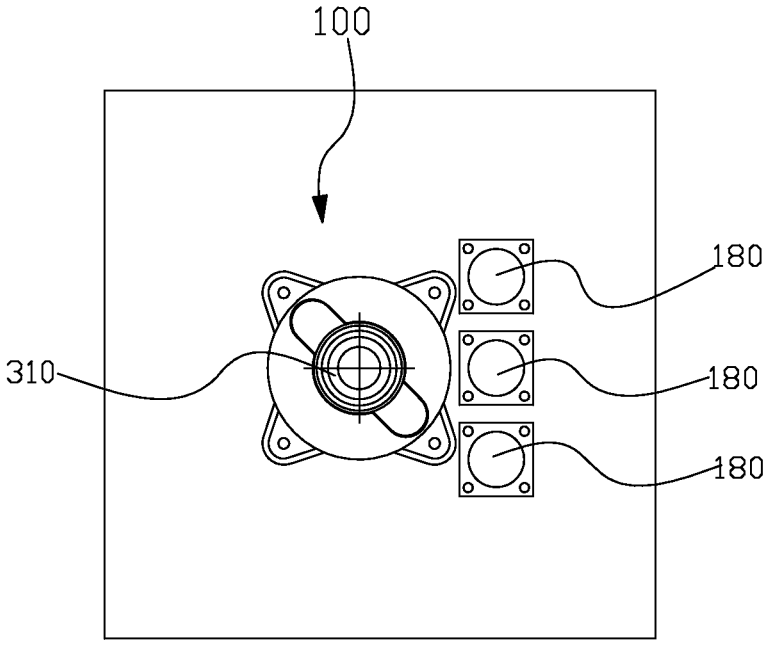
FIG. 9 shows the vertical view of the shower without the top cover in the present invention according to the preferred embodiment 3.

As shown in FIG. 6, FIG. 7 and FIG. 8, it is the abridged general view of the shower with waterway switch controlled by electronic touch in the present invention.

A shower with waterway switch controlled by electronic touch, it comprises a fixing seat 100, a power generation mechanism, an effluent unit 200 and a control unit. The effluent unit with three effluent ways is taken as an example in the present embodiment, but it is not limited, others are fit to the present invention such as two or four.

The said fixing seat 100 comprises a top cover 120, an interface 130, a supporting seat 140, a connecting seat 150, a fixing sleeve 160 and three magnetic valves 180 (it is equal to the count of the effluent way).

The said bottom cover 110 and the top covers 120 are fixed to each other and form a shell together.

A perforative through hole is opened in the said top cover 120, and the said interface 130 is fixed on the through hole of the top cover 120 to connect the water resource and to achieve fixing connection, such as connecting to the American supporting arm 500 in FIG. 1.

The said supporting seat 140 is fixed on the bottom cover 110, and the said connecting seat 150 is fixed on the supporting seat 140, and the said fixing sleeve 160 is fixed to the interface 130 and between the top cover 120 and the connecting seat 150, namely the supporting seat 140, the connecting seat 150 and the fixing sleeve 160 are fixed in the shell formed by the effluent unit 200 and the top cover 120.

The bottom surface of the supporting seat 140 sinks and forms a concave cavity 141, and the said supporting seat 140 is hermetically fixed upon the effluent unit 200, namely the opening of the concave cavity 141 is sealed by the effluent unit 200. A connecting channel 142 is opened in the top surface of the said supporting seat 140, and the upper end of the said connecting channel 142 is connected to the main waterway 161, and the lower end of the said connecting channel 142 is connected to the concave cavity 141; the lateral face of the said supporting seat 140 sinks and forms three independent branch waterways 143; the top surface of the said supporting seat 140 sinks and forms three mounting holes 144, each mounting hole 144 is connected to a branch waterway 143 and the concave cavity 141. The said magnetic valves 180 are mounted in the mounting holes 144 and control the connection of the branch waterways 143 and the concave cavity 141. A notch 145 is set at the lower part of the edge part of the said supporting seat 140.

The said connecting seat 150 is hermetically fixed on the supporting seat 140, and a containing cavity 151 is formed between the said connecting seat 150 and the supporting seat 140, and a oblique water hole 150 connecting the main waterway 161 is opened in the said connecting seat 150, and the said containing cavity 151 connects the oblique water hole 152 with the connecting channel 142.

The said fixing sleeve 160 is fixed to the interface 130 and between the top cover 120 and the connecting seat 150, in which a main waterway 161 connecting the interface 130 and the oblique water hole 152 is opened.

The said power generation mechanism has a generator 310 and a impeller 320, the generator 310 is fixed in the fixing sleeve 160, the rotation shaft of the said generator 310 penetrates the connecting seat 150 from top to bottom and enters the containing cavity 151, and the said impeller 320 is set in the containing cavity 151 and is connected to the rotation shaft. The power generation mechanism generates electric energy by the impact of the waterway in the main waterway.

The said control unit comprises a circuit board 140 and a touch panel 420. The said circuit board 410 is set at the notch 145 of the supporting seat 140 and fixed with effluent unit 200 through the supporting seat 140. The said touch panel 420 is set on the lateral face of the effluent unit 200, and it is easy to control and touch for the users. The said circuit board 410 is connected to the generator 310 of the power generation mechanism to gain the electric energy, and the said circuit board 410 is connected to the touch panel 420 to receive the touch signals of the users and figure out the control signals according to the touch signals of the users, and the said circuit board 410 is connected to the three magnetic valves 180 with signals to control the on and off of the magnetic valves 180 with the control signals.

The effluent unit 200 is fixed under the fixing seat 110. The said effluent unit 200 has three effluent functions; each of the said three effluent functions is connected to each of the branch waterways respectively.

The waterway of the shower in the present embodiment is the interface 130, the main waterway 161, the oblique water hole 152, the containing cavity 151, the connecting channel 142, the concave cavity 141, the magnetic valve 180, the branch waterway 143 and the effluent function.

Embodiment 4

Figure 10:
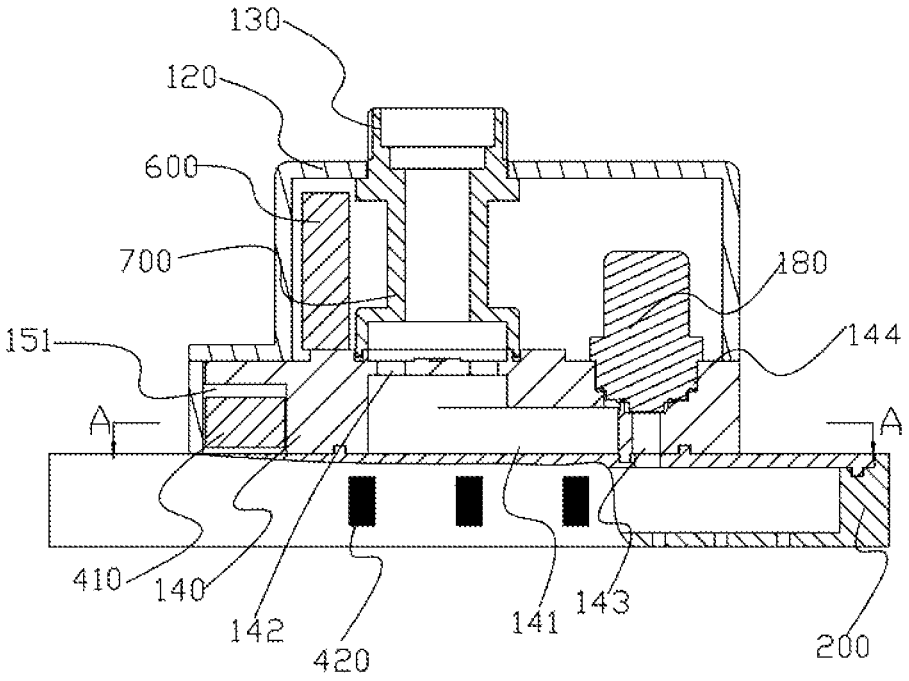
FIG. 10 shows the diagrammatic cross-section of the shower in the present invention according to the preferred embodiment 4.

As shown in FIG. 10, the differences from the previous embodiment are: the power generation mechanism is replaced by the battery 600; the fixing seat and the connecting seat are not needed, a water catching pipe 700 is fixed between the interface and the supporting seat, connecting the interface and the waterway.

Other Embodiments

A storage battery can be added to the technical proposals of the embodiment 1 and 3 in the present invention, of which the input end is connected to the output end of the generator 310. The generator 310 directly charges the storage battery when the workings of the magnetic valves 180 are not needed.

The invention has been described with reference to the preferred embodiments mentioned above; therefore it cannot limit the reference implementation of the invention. It is obvious to a person skilled in the art that structural modification and changes can be carried out without leaving the scope of the claims hereinafter and the description above.

INDUSTRIAL APPLICABILITY

A shower with waterway switch controlled by electric touch in the present invention combines the electric touch control, power generation mechanism and the waterway switch together in the shower field and cooperates with the shower to make the waterway switch easy.

What is claimed is:

1. A shower with waterway switch controlled by electronic touch, further comprising:

a fixing seat, having a main waterway connecting to the water source and at least two branch waterways, each said branch waterway connected to the main waterway through a magnetic valve;

a power generation mechanism, fixed in the fixing seat and generating electric energy by impact of water flow in the main waterway;

an effluent unit, fixed to the fixing seat and having effluent functions corresponding to each of the branch waterways; and a control unit, including a circuit board fixed in the fixing seat and a touch panel fixed outside the fixing seat, said circuit board connected to the power generation mechanism to gain electric energy, said circuit board connected to the touch panel to receive touch signals from users and figure out control signals according to the touch signals, said circuit board connected to the magnetic valves to control on and off switching of the magnetic valves by the control signals, and the said touch panel is located at an end of the shower's effluent face or the shower's lateral face, wherein said fixing seat comprises a top cover, a bottom cover, a supporting seat and a sealing cover, said bottom cover and the top cover are fixed together, said supporting seat is set between the bottom cover and the top cover; the bottom surface of the said supporting seat sinks and forms a concave cavity, said sealing cover seals the opening of the concave cavity, a connecting channel is opened in the top surface of the supporting base, the upper end of the connecting channel is hermetically connected to the main waterway, and the lower end of the connecting channel is connected to the concave cavity; the lateral face of the supporting seat sinks and forms said branch waterways; the top surface of the supporting seat sinks and forms several mounting holes, and each mounting hole is connected to a branch waterway and the concave cavity, and said magnetic valves are mounted in said mounting holes and are configured to control switching the connection between the concave cavities and the branch waterways on and off.

2. A shower with waterway switch controlled by electronic touch according to claim 1, wherein said circuit board is set between the supporting seat and the bottom cover.

3. A shower with waterway switch controlled by electronic touch according to claim 1, wherein said power generation mechanism is set between the supporting seat and the top cover, and is connected to the main waterway.

4. A shower with waterway switch controlled by electronic touch according to claim 1, wherein said effluent unit is fixed on a lateral face of the fixing seat, and an effluent face of the said effluent unit forms an included angle with the bottom surface of the bottom cover, and said touch panel is set on the bottom surface of the bottom cover.

5. A shower with waterway switch controlled by electronic touch according to claim 1, wherein said fixing seat further comprises a connecting seat, the connecting seat is hermetically fixed on the supporting seat, a containing cavity is formed between the connecting seat and the supporting seat, an oblique water hole connecting the main waterway is opened in said connecting seat, and the containing cavity connects the oblique water hole and the connecting channel; and said power generation mechanism has a generator and a impeller, said generator is fixed between the connecting seat and the top cover, and the rotation shaft of said generator penetrates the connecting seat from top to bottom and enters the containing cavity, and the said impeller is set in the containing cavity, connected to the rotation shaft.

6. A shower with waterway switch controlled by electronic touch according to claim 5, wherein a fixing sleeve used for fixing and sleeving the generator is fixed on said connecting seat, and said main waterway is set on the fixing sleeve, connecting the water source and the oblique water hole.

7. A shower with waterway switch controlled by electronic touch according to claim 1, further comprising a storage battery of which an input end is connected to an output end of a generator, and the generator directly charges the storage battery when the magnetic valve is not working.

8. A shower with waterway switch controlled by electronic touch, further comprising:

a fixing seat, having a main waterway connecting to the water source and at least two branch waterways, each said branch waterway connected to the main waterway through a magnetic valve;

a power generation mechanism, fixed in the fixing seat and generating electric energy by impact of water flow in the main waterway;

an effluent unit, fixed to the fixing seat and having effluent functions corresponding to each of the branch waterways; and a control unit, including a circuit board fixed in the fixing seat and a touch panel fixed outside the fixing seat, said circuit board connected to the power generation mechanism to gain electric energy, said circuit board connected to the touch panel to receive touch signals from users and figure out control signals according to the touch signals, said circuit board connected to the magnetic valves to control on and off switching of the magnetic valves by the control signals, and the said touch panel located at an end of the shower's effluent face or the shower's lateral face, wherein said fixing seat comprises a top cover and a supporting seat, the said effluent unit is under the fixing seat and fixed with the top cover, and the said supporting seat is set between the effluent unit and the top cover;

a bottom surface of said supporting seat sinks and forms a concave cavity, said effluent unit is hermetically fixed to an opening of the concave cavity, a connecting channel is opened in the top surface of said supporting seat, an upper end of said connecting channel is hermetically connected to the main waterway, and a lower end of said connecting channel is connected to the concave cavity;

the bottom surface of the supporting seat sinks and forms said branch waterways;

the top surface of the said supporting seat sinks and forms several mounting holes, and each mounting hole connects a branch water way and the concave cavity; and said magnetic valve is mounted in the mounting hole and controls switching a connection between the concave cavity and the branch waterways on and off.

9. A shower with waterway switch controlled by electronic touch according to claim 8, further comprising a storage battery of which an input end is connected to an output end of a generator, and the generator directly charges the storage battery when the magnetic valve is not working.

10. A shower with waterway switch controlled by electronic touch, the shower comprising:

a fixing seat, having a main waterway connecting to the water source and at least two branch waterways, each the said branch waterway connected to the main waterway through a magnetic valve;

a battery, fixed in the fixing seat and generates electric energy;

an effluent unit, fixed to the fixing seat and having effluent functions corresponding to each of the branch waterways; and a control unit, including a circuit board fixed in the fixing seat and a touch panel fixed outside the fixing seat, the said circuit board connected to the battery to gain the electric energy, the said circuit board is signaling connected to the touch panel to receive touch signals from users and figure out control signals according to the touch signals, the said circuit board connected to the magnetic valves to control on and off switching of the magnetic valves by the control signals, wherein said fixing seat comprises a top cover, a bottom cover, a supporting seat and a sealing cover, the said bottom cover and the top cover are fixed together, said supporting seat is set between the bottom cover and the top cover; the bottom surface of said supporting seat sinks and forms a concave cavity, said sealing cover seals the opening of the concave cavity, a connecting channel is opened in the to surface of the supporting base, the upper end of the connecting channel is hermetically connected to the main waterway, the lower end of the connecting channel is connected to the concave cavity; the lateral face of the supporting seat sinks and forms said branch waterways; the to surface of the supporting seat sinks and forms several mounting holes, each mounting hole is connected to a branch waterway and the concave cavity, and said magnetic valves are mounted in said mounting holes and are configured to control switching the connection between the concave cavities and the branch waterways on and off.

* * * * *